United States Patent [19]

Frank et al.

[11] Patent Number: 4,621,641

[45] Date of Patent: Nov. 11, 1986

[54] VAPORIZER AND/OR FACIAL TREATMENT DEVICE

[76] Inventors: Bernard Frank, 10155 Collins Ave., Apt. 407, Bal Harbour, Fla. 33154; Melvin B. Greenberg, 20500 NE. 20th Pl., North Miami Beach, Fla. 33179

[21] Appl. No.: 684,439

[22] Filed: Dec. 21, 1984

[51] Int. Cl.[4] ..... A61H 33/12

[52] U.S. Cl. ..... 128/368; 4/537; 219/271

[58] Field of Search ..... 128/368; 34/99, 100; 4/535, 536, 537; 219/271, 275; 223/51

[56] References Cited

U.S. PATENT DOCUMENTS 2,378,929 6/1945 Joyce ..... 128/206.15
3,335,503 8/1967 Genger ..... 34/100
3,351,737 11/1967 Katzman et al. ..... 4/537 X
3,493,722 2/1970 Popeil ..... 128/368 X
3,949,743 4/1976 Shanbrom ..... 128/368 X
4,419,994 12/1983 Hilton ..... 128/206.19

FOREIGN PATENT DOCUMENTS 2110543 6/1983 United Kingdom ..... 128/200.23

*Primary Examiner*—Anton O. Oechsle

[57] ABSTRACT

A vaporizer and/or facial treatment device includes a casing in it for retaining a liquid to be vaporized, and a hood having collapsible shield section movable from an opened, extended condition for controlling the flow of steam exiting through an opening in the casing, to a closed, collapsed condition when the hood is not in use.

28 Claims, 12 Drawing Figures

VAPORIZER AND/OR FACIAL TREATMENT DEVICE

BACKGROUND OF THE INVENTION

This invention relates generally to a vaporizer and/or facial treatment device, and more specifically to a device of the type employing a hood for controlling the direction of steam flow therefrom.

Vaporizing devices of the type employed for complexion care, such as to provide steam facials, are known in the art, as exemplified by U.S. Pat. Nos. 3,351,737 (Katzman et al.) and 3,152,240 (Scott). These units employ rigid hood members having an open end over which a person can place his or her face for receiving facial steam treatment. These devices are generally bulky and difficult to transport due to the size and rigidity of the hoods employed in them.

A number of prior art devices are disclosed for use in the steam treatment of fabrics, primarily for the purpose of removing wrinkles or improving the definition of desired pleats or creases. Typical prior art devices of this type are disclosed in U.S. Pat. Nos. 3,395,469 (Gilbert); 3,436,851 (Gilbert); 3,470,719 (Frank) and 3,690,024 (Osrow). Moreover, a commercially available portable hand steamer for fabrics presently is being sold under the trademark WRINKLES AWAY by Franzus Company, 352 Park Avenue South, New York, N.Y. 10010. These fabric treating devices employ a detachable head having a generally planar "ironing" surface through which steam is adapted to be ejected for the purpose of treating the fabric.

It is also known to design lightweight, portable hair dryers with a collapsible hood that is adapted to be opened up and placed over a user's head for the purpose of drying his or her hair, and which then can be folded up into a compact arrangement for storage when the dryer is not being used. A dryer of this type is disclosed in U.S. Pat. No. 4,361,966, issued to Downey.

OBJECTS OF THE INVENTION

It is an object of this invention to provide a vaporizer and/or facial treatment device emloying a hood for controlling the flow of steam, and which can be maintained in a more compact and easily transportable arrangement than prior art devices.

It is a further object of this invention to provide a vaporizer and/or facial treatment device which can be converted easily for other uses in which steam desirably is utilized.

It is a further object of this invention to provide a vaporizer and/or facial treatment device which can be easily modified for use as a portable steamer, or iron, for removing wrinkles from fabrics or otherwise employed to freshen the appearance of such fabrics.

SUMMARY OF THE INVENTION

The above and other objects of this invention are achieved in a vaporizer and/or facial treatment device including a casing having a compartment therein for receiving a liquid to be vaporized. An opening communicates with said compartment to permit steam created by the vaporization of the liquid to exit. The invention employs a unique collapsible hood having a collapsible shield section being movable from an opened, extended condition for controlling the direction of flow of steam exiting through the opening in the casing, to a closed, collapsed condition when the hood is not intended to be utilized. Most preferably the collapsible hood is also removable from the casing, and includes a hub section attached to the shield section and having a passageway therethrough, said hub section being removably attachable to said casing with the passageway in the hub section aligned with the opening that communicates with the compartment.

In a preferred arrangement the hub section of the removable and collapsible hood is designed to be removably connected to the casing of a portable fabric steamer, such as, for example, the WRINKLES AWAY fabric steamer referred to earlier, to replace the fabric treating head thereof when the unit is intended to be used either as a vaporizer or facial treatment device. Thus, in accordance with this aspect of the invention the removable and collapsible hood provides the added versatility of permitting vaporizing devices to be modified to provide multiple functions. In accordance with the broadest aspects of this invention portable tanks or casings other than those used with fabric steamers also can be employed.

DESCRIPTION OF THE PREFERRED EMBODIMENTS OF THE INVENTION

Figure 1:
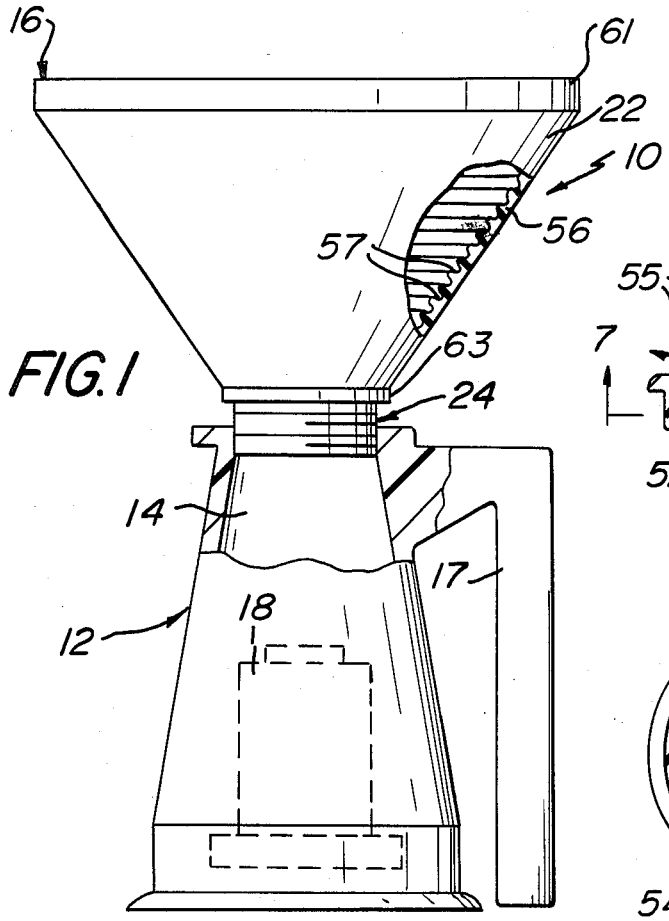
FIG. 1 is a side elevation view, partly in section, showing a vaporizer and/or facial treatment device in accordance with this invention.

Referring now in greater detail to the various figures of the drawings wherein like reference characters refer to like parts, a vaporizer and/or facial treatment device embodying the present invention is generally shown at 10 in FIG. 1. This device basically comprises a unitary molded plastic casing 12 having an interior chamber 14 in which liquid (e.g., water) to be vaporized is contained, and a removable and collapsible hood 16 usable with the casing for controlling the flow of steam flow and, when necessary, water droplets exiting from the interior chamber 14. The liquid is heated within the chamber 14 by a conventional metal heating element 18, which can be of the type disclosed in the Frank U.S. Pat. No. 3,470,719. This latter patent is hereby incorporated herein by reference. However, it should be noted that other mechanisms can be used to heat the liquid, the specific heater not constituting a part of the present invention.

In the illustrated embodiment the unitary molded plastic casing 12 includes a handle 17 as a part thereof, and actually is the casing employed in the fabric treatment steamer being sold by Franzus, Inc. under the trademark WRINKLES AWAY, which steamer was invented by Mr. Bernard Frank, the inventor of the subject matter described and claimed herein. A fabric treatment steamer of the WRINKLES AWAY type can be modified in accordance with this invention to function as a vaporizer and/or facial treatment device by merely replacing the fabric caressing head employed on the fabric treatment steamer with a unique removable and collapsible hood of the present invention. The size of the hood can be varied within wide limits, as desired. For example, when the hood substantially circular in plan view, and is used as part of a facial steam treatment device, the open end of the hood can have a diameter of approximately 4 inches to 8 inches, and a height of from about 4 inches to 12 inches.

Figure 2:
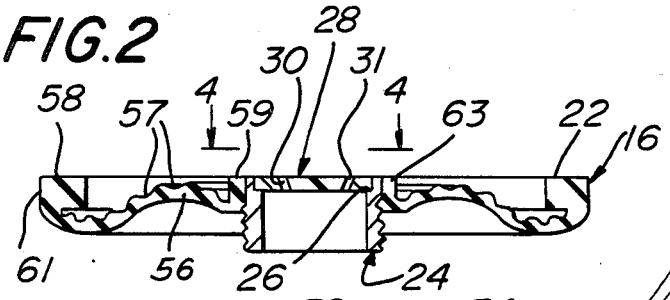
FIG. 2 is a sectional view through the hood of the device shown in FIG. 1, but with the hood in a collapsed condition.

Referring specifically to FIGS. 1 and 2, a removable and collapsible hood 16 employed in the vaporizer and facial treatment device 10 includes a collapsible shield section 22 which is substantially conical in its opened, operative condition, and a centrally located, threaded hub 24 connected to said shield section. The threaded hub 24 is adapted to cooperate with complimentary threads located adjacent the periphery of the opening into the chamber 14 of the casing 12 for permitting the collapsible hood 16 to be removably connected to said casing.

If desired the hub 24 need not be threaded. It can be constructed to be frictionally retained on the casing, or with other fastener means, such as a key or keyway for cooperating with a complementary keyway or key of the casing.

Figure 3:
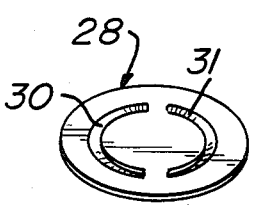
FIG. 3 is an isometric view of a baffle employed in the collapsible hood for controlling steam flow.
Figure 4:
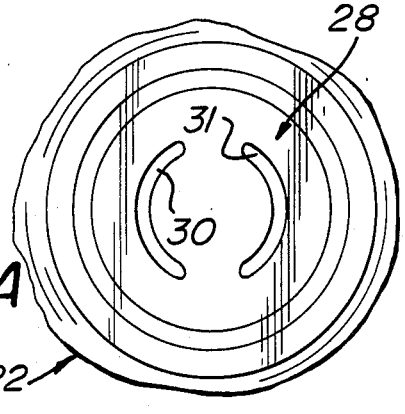
FIG. 4 is a plan view taken along line 4—4 of FIG. 2.

Referring to FIGS. 2, 3 and 4, the hub 24 includes a countersunk section adjacent its upper end to provide a supporting shelf 26 for a baffle, in the form of a substantially planar disk 28. This disk 28 includes steam-directing orfices therein, in the form of arcuate passages 30 and 31. However, if desired, the number, arrangement and shape of these passages can be varied within wide limits.

In accordance with a preferred embodiment of this invention, the passages 30 and 31 are inclined generally outwardly in the direction in which steam flows through them (i.e., inclined outwardly to the axis of the opening into the chamber 14 of the casing 12). This arrangement is illustrated in a somewhat exaggerated form in FIG. 2. Inclining the passages is most desirable to prevent hot water droplets from engaging a user's face when the device is being used to provide facial steam treatment, and the hood is not sufficiently high to preclude hot water droplets that enter the shield section from moving through the shield section and engaging the user's face. In particular, by inclining the passages 30 and 31, the surfaces thereof will intercept the steam and cause water droplets to condense on said surfaces, rather than passing through the passages and contacting a user's skin.

The use of the flow control passages 30 and 31, even when not inclined, advantageously prevents a high velocity flow of steam from exiting through the hood, and possibly injuring a user of the device.

Figure 3A:
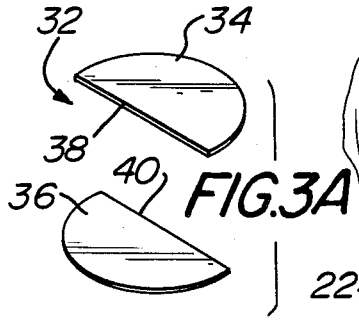
FIG. 3A is an exploded isometric view of an alternative baffle arrangement usable in this invention.
Figure 5:
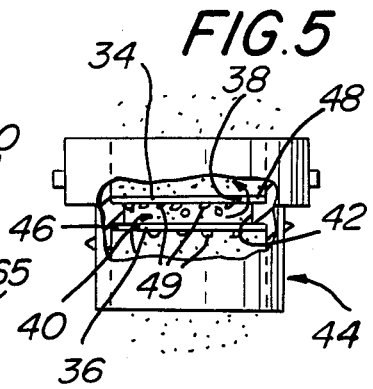
FIG. 5 is a sectional view showing the manner in which the baffle of FIG. 3A cooperates with other elements of the hood to control steam flow.

Referring specifically to FIGS. 3A and 5, an alternative baffle 32 includes a pair of substantially flat, generally circular disks 34 and 36, with a segment of each disk omitted to provide substantially linear surfaces 38 and 40, respectively. As can be seen best in FIG. 5, the disks 34 and 36 are retained on opposite sides of a generally annular rib 42 molded integrally as part of a hub 44. The upper disk 34 can be supported on the upper surface of the rib by gravity, or alternatively can be bonded to said rib. Most preferably, the lower disk 36 is bonded to the lower surface of the rib 42, with its generally linear surface 40 being displaced 180° from the generally linear surface 38 of the disk 34. As a result of this arrangement steam directed through the hub 44 will first be directed through the passage 46, defined by the space between the rib 42 and the linear surface 40 of the disk 36, will then move generally horizontally between the disks 34 and 36, and finally will exit through the passage 48 defined by the space between the rib 42 and the liner surface 38. As the steam moves past the disks 34 and 36 of the baffle 32 water droplets will condense on the lower surfaces of said disks, as is illustrated at 49, and thereby be prevented from moving through the hood into engagement with a user's face.

The baffle 32 illustrated in FIGS. 3A and 5 is very efficient in preventing water droplets from exiting through the hood, but does not distribute the flow of steam throughout the entire open area of said hood. However, when the hood is sufficiently high, the steam exiting through the passage 48 will distribute itself throughout the interior of said hood.

Figure 6:
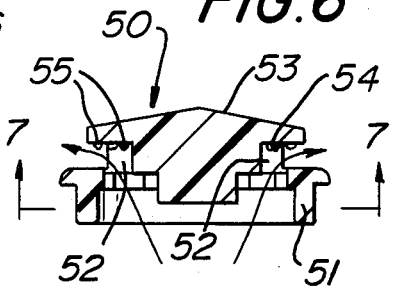
FIG. 6 is a sectional view of an alternative baffle arrangement usable in this invention.
Figure 7:
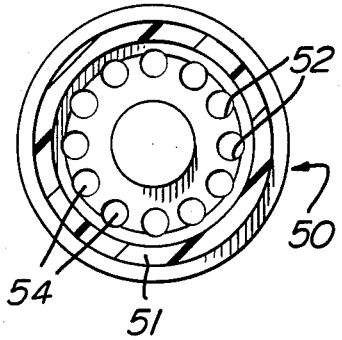
FIG. 7 is a horizontal section view of the complete baffle taken along line 7—7 of FIG. 6.

Referring to FIGS. 6 and 7, an alternate baffle is illustrated at 50. This baffle is a unitary, molded plastic member having a lower annular skirt section 51 that can be inserted into the interior of the hub 24, and attached to said hub by an suitable means, such as by ultrasonic bonding or by a suitable bonding material. Alternatively, it may be possible to merely frictionally retain the skirt section 51 of the baffle in engagement with the interior surface of the hub 24.

The baffle 50 includes a plurality of circumferentially spaced-apart passages 52, and an upper hood section 53 extending radially beyond said passages. The hood section 53 includes a downwardly facing surface 54 for radially diverting the flow of steam exiting from the passages 52, as is illustrated by the arrows in FIG. 6. This will prevent direct impingement of concentrated steam against the user's face, or against other parts of the user's body. Moreover, impingement of the steam against the downwardly facing surface 53 will cause water droplets to condense on said surface, as is illustrated at 55, and thereby prevent said water droplets from moving through the hood and into engagement with the user's face, or other parts of the user's body.

Referring again to FIGS. 1 and 2, the peripheral wall section 56 includes a plurality of reduced thickness areas 57 which provide flexible hinge sections about which said peripheral wall section can be flexed, or stretched, to permit the hood 16 to be collapsed into the position illustrated in FIG. 2. In the most preferred embodiment of this invention upper surfaces 58 and 59 of the upper and lower circumferential sections 61 and 63 of the hood 16 lie substantially in the same plane when the hood is in its fully collapsed condition.

Most preferably the hood 16 is made from a flexible rubber or rubber-like material, and is constructed similar to the TELESOR collapsible lens shade, No. 26052RH, that is used with cameras. As described on the package, this lens shade is imported from Korea, and is distributed exclusively by Masel Supply Company Corp. of Brooklyn, N.Y. However, it is within the scope of the invention to use other materials in forming the hood 16; the important requirement being that a plurality of flexible hinge regions be provided to permit the hood to be collapsed.

It should be understood that the removable and collapsible hood 16 can be attached directly to the casing 12 in place of a head normally employed to treat fabrics, to thereby convert the fabric treating device to a vaporizer and/or facial treatment device. Alternatively, the removable and collapsible hood 16 can be employed with other lightweight portable devices or casings that generate water vapor or steam to thereby provide a portable vaporizer and/or facial treatment device.

Figure 8:
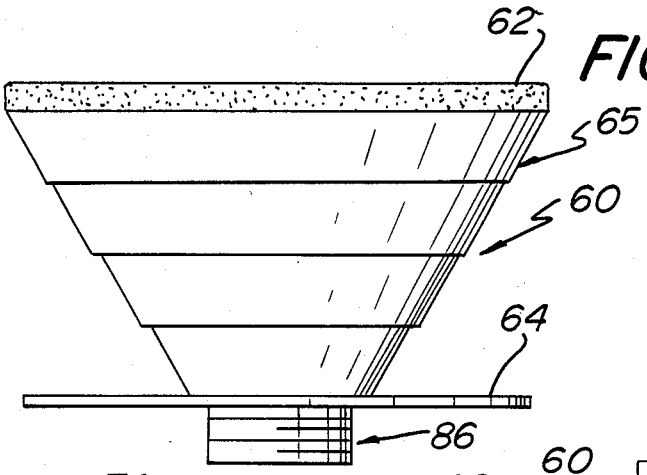
FIG. 8 is a side elevational view of an alternative embodiment of a removable and collapsible hood in accordance with this invention.
Figure 9:
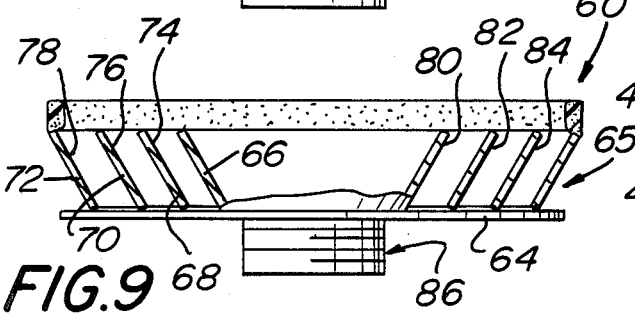
FIG. 9 is a sectional view through the removable and collapsible hood shown in FIG. 8, but with the hood in a collapsed condition.

Referring to FIGS. 8 and 9, a second embodiment of a removable and collapsible hood in accordance with this invention is generally shown at 60. This hood includes an upper, flexible rim 62, a lower substantially planar support member 64 and a collapsible shield section 65 provided by a plurality of telescoping, substantially frusto-conical disk sections. In the illustrated embodiment four such disk section 66, 68, 70 and 72, are employed. However, the exact number of such disk sections can be varied depending upon the desired height of the hood.

The innermost disk 66 is bonded to the lower support member 64, and the remaining disks are circumferentially oriented relative to each other so that sections of adjacent disks overlap each other in the direction of movement of the shield section 65 between its extended and collapsed conditions. This arrangement of disks prevents their separation when the shield is in a fully opened condition, as is illustrated in FIG. 8. Specifically, when the shield section 65 is in its opened condition the inner surfaces 74, 76 and 78 of the disks 68, 70 and 72 frictionally engage the outer surfaces 80, 82 and 84 of the disks 66, 68 and 70, respectively. This frictional engagement prevents the disks from separating from each other when the shield section 65 is in its opened condition, and also retains said shield section in its opened condition. When the hood 60 is collapsed, separation of the individual disks is prevented by the lower support member 64, as is shown in FIG. 9.

The hood 60 includes a hub 86, which can be identical to either the hub 24 or the hub 44. The baffles 28 and 50 can be employed with either of the hubs 24 or 44. However, if it is desired to employ the baffle 32, which includes the substantially flat disks 34 and 36, then the hub 44 desirably is utilized.

As an alternate arrangement, flow control passages can be formed directly in the lower support member 64 in alignment with a central passageway in the hub 86. If desired, the hub 86 can be integrally foremd with the support member 64, either in a configuration to receive the baffles 28 or 50, the cooperating disks 34 and 36 of the baffle 32, or with the flow control passages directly formed in the support member.

Figure 10:
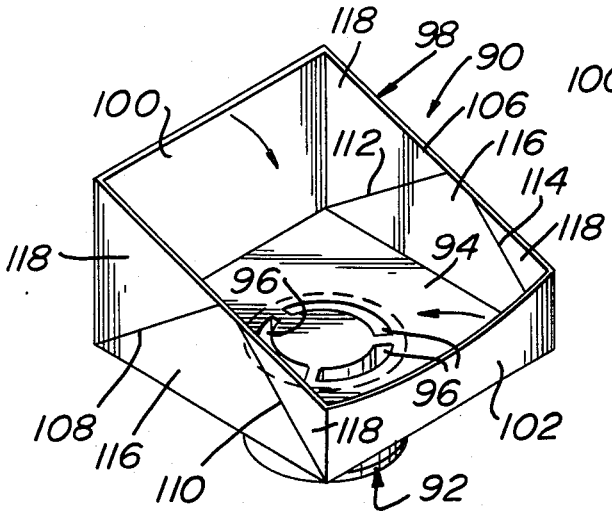
FIG. 10 is a isometric view of an additional embodiment of a removable and collapsible hood in accordance with this invention.

Referring to FIGS. 9 and 10, a third embodiment of a removable and collapsible hood is generally shown at 90. This hood includes a hollow hub 92 integrally molded or otherwise formed with a lower plate or wall 94. A plurality of arcuate passages 96, similar to passages 30 and 31 of the first embodiment of this invention, are molded into the lower wall 94 and communicate with the interior of the hollow hub 92. Of course, the number, shape and arrangement of passages can be varied as desired. The collapsible hood 90 is completed by a collapsible shield section 98 provided by a rear peripheral wall 100, a front peripheral wall 102 and a pair of laterally spaced-apart peripheral side walls 104 and 106, respectively. It should be understood that the number of peripheral walls can be varied (e.g., 5, 6, etc.), and when the device is to be used soley as a vaporizer to humidify a room, one or more of the peripheral wall areas may be omitted.

Figure 11:
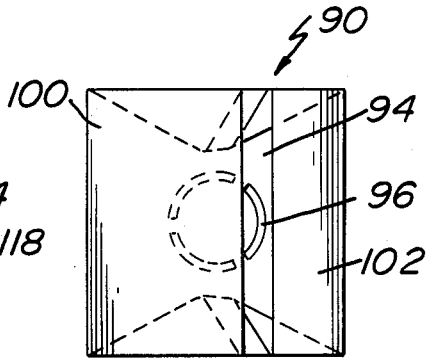
FIG. 11 is a plan view of the hood shown in FIG. 10, but in a folded, collapsed condition.

Still referring to FIGS. 9 and 10, a pair of inclined scorelines 108 and 110 are formed in one of the side walls 104 and a second pair of inclined scorelines 112 and 114 similar to the scorelines 108 and 110, are formed in the opposed side wall 106. These scorelines provide regions along which the side walls 104 and 106 can fold or collapse inwardly (or outwardly, if desired) to permit the hood assembly 90 to be collapsed into the configuration illustrated in FIG. 11. More specifically, the inclined scorelines associated with each of the sidewalls define generally medial triangular sections 116 and marginal triangular sections 118 which are adapted to be collapsed inwardly when the rear and front planar walls 100 and 102 are folded inwardly in the direction indicated by the arrows in FIG. 10.

A variant of the arrangement illustrated in FIG. 9, wherein front peripheral wall 102 is not employed, and the peripheral side walls 104 and 106 had a substantially curved upper edge, was designed by Michael Young, subsequent to the invention described and claimed herein, and after he was provided with a confidential disclosure of the features illustrated in FIGS. 1–5 of the instant application.

Referring again to FIG. 10, the height of the collapsible hood 90 can be varied, the particular dimensions shown in the drawing being solely for the purpose of illustrating this embodiment of the invention. In order to increase the height of the hood, the dimension of the lower plate or wall 94 between the rear wall 100 and the front wall 102 needs to be increased to accommodate the increased dimensions of the rear wall and front wall when they are folded into overlying relationship with the lower wall. Moreover, the arrangement of score lines most likely will need to be modified in order to permit the laterally-spaced apart side walls 104 and 106 to be collapsed with the rear wall 100 and front wall 102. The particular arrangement of scorelines will depend upon the particular height of the hood 90, and can be easily determined by a person skilled in the art.

It should be understood that the collapsible hood 90 illustrated in FIGS. 9 and 10 can be made with a hub that is removable from the bottom wall 94, such as by a screw connection, and with a baffle arrangement for controlling the flow of steam and/or water droplets, such as either the baffle 28 illustrated in FIG. 3, the baffle 32 illustrated in FIG. 3A, or the baffle 50 illustrated in FIG. 6.

The provision of a removable and collapsible hood having a hub section which is removably connectable to a casing in which water is retained and vaporized, as is included in the most preferred embodiments of this invention, provides several advantages which are not taught in the prior art. First, due to its removable and collapsible construction, the hood can be removed from, and packaged with the casing in a very compact manner to permit a larger number of units to be displayed for sale within a given volume of shelf space, or alternatively, to permit the use of less shelf space to display a given number of such units. Moreover, the compact arrangement of the unit permits it to be more easily transported for use in various locations.

A further advantage resides in the ability to use the removable and collapsible hoods of this invention as a separate attachment for steam vaporizing units that also are capable of uses for applications other than humidifying a room or applying steam treatment to a part of the human body. For example, and as explained earlier, in a preferred embodiment of this invention the hub sections of the various collapsible hoods are designed to be removably attached to the casing of the WRINKLES AWAY fabric treating unit, in place of the ironing head generally employed on said unit. Therefore, the WRINKLES AWAY unit either can be employed with the ironing head in a conventional manner for treating fabrics, or it can be provided with the removable and collapsible hoods of this invention to direct the flow of steam into a desired area to be humidified, or into direct engagement with a user's skin for the purpose of providing steam treatment thereto. In these latter two applications an enlarged base may be employed for receiving the lower end of the casing of the WRINKLES AWAY unit to aid in supporting and stabilizing the unit on a supporting surface, such as the top of a table.

Without further elaboration, the foregoing will so fully illustrate my invention that others may, by applying current or future knowledge, adopt the same for use under various conditions of service.

What is claimed as the invention is:

1. A vaporizer and/or facial treatment device including a casing having a compartment therein for retaining liquid to be vaporized, an opening communicating with said compartment through which steam created by vaporization of said liquid exits from said compartment, and a heating means for vaporizing said liquid; characterized by a hood assembly releasably mountable on said casing, said hood assembly including a collapsible shield section comprising a base wall portion having a first opening therein, wall means connected to the base wall portion and projecting outward therefrom for releasably securing said hood assembly to the opening of said casing, at least one side wall portion secured to said base wall portion, said side wall portion including side wall sections and movable joint means, said joint means enabling sections of said side wall portion to move with respect to said base wall portion to extend upward therefrom, whereupon said hood assembly assumes an opened, extended condition having a free end opening substantially larger in area than said first opening, said opened hood assembly confining the flow of steam exiting through the opening of the casing compartment and for directing it to said free end opening, said joint means also enabling sections of said side wall portion to move with respect to said base wall portion to a closed, compact and fully collapsed condition during non-use of said hood assembly.

2. A device of claim 1 characterized in that said wall means comprises a hub section with a passageway therethrough, said passageway communicating with said first opening and the opening into the compartment of the casing, said base wall portion of said collapsible shield section being attached to said hub section.

3. The device of claim 2 characterized in that the hub section is removably attachable to said casing.

4. The device of claim 3 characterized in that the hood assembly includes flow control passages adjacent a lower end of the collapsible shield section and communicating with the passageway through the hub section for controlling steam flow passing through said hub.

5. The device of claim 4 characterized in that the flow control passages are inclined to the axis of the opening communicating with the compartment of the casing.

6. The device of claim 4 characterized in that said passages are provided in an integral, non-removable part of the hood assembly.

7. The device of claim 4 characterized in that said passages are in a member removably supported on a surface of the hub section.

8. The device of claim 1 characterized by the hood assembly including flow control passages adjacent a lower end of the collapsible shield section and communicating with the passageway through a hub section for controlling steam flow passing through said hub section, said assembly also including a pair of generally parallel lower and upper baffle members spaced from each in the general direction of steam flow, said baffle members including surfaces transversely spaced from each other, each of said surfaces defining a boundary of a flow control passage for permitting steam to exit through the passage in the lower member, move tranversely between said lower and upper members and pass through the passageway in the upper member.

9. The device of claim 1 characterized in that the shield section is comprised of a flexible, stretchable material and wherein said joint means comprises a plurality of movable hinge sections about which the sections of said side wall portion can be pivoted for movement between said opened and closed conditions.

10. The device of claim 9 characterized in that said base wall portion is integral with said shield section.

11. The device of claim 9 characterized in that the plurality of hinge sections are provided by a plurality of circumferentially spaced flexible and stretchable thin regions separated by less flexible thicker regions.

12. The device of claim 10 characterized in that said wall means connected to the base wall portion comprises a hub section.

13. The device of claim 1 characterized in that the collapsible shield section includes a plurality of concentric, substantially conical disks and a lower support member forming said base wall portion, said inner disk being of smaller diameter than the next adjacent disk and being attached to said lower support member, adjacent disks overlapping each other in the direction of movement of the shield section between the opened and closed conditions thereof, whereby adjacent surfaces of said adjacent disks form said joint means by engaging each other in the opened condition of the shield section for maintaining the shield section in said opened condition, said lower support member underlying all of said disks to provide a supporting surface for said disks in the collapsed condition of the shield section.

14. The device of claim 13 characterized in that a flexible ring member is secured to the upper surface of the outermost conical disk.

15. The device of claim 13 characterized in that said wall means connected to the base wall portion comprises a hub section.

16. The device of claim 15 characterized in that the hub section is attached to the lower support member and extends downwardly therefrom.

17. The device of claim 13 characterized in that the hood assembly includes flow control passages adjacent a lower end of the collapsible shield section and communicating with the passageway through the hub section for controlling steam flow passing through said hub section.

18. The device of claim 17 characterized in that said passages are provided in an integral, non-removable part of the hood assembly.

19. The device of claim 17 characterized in that said passages are in a disk removably supported on a surface of the hub section.

20. The device of claim 17 characterized by a pair of generally parallel lower and upper baffle members spaced from each in the general direction of steam flow, said baffle members including surfaces transversely spaced from each other, each of said surfaces defining a boundary of a flow control passage for permitting steam to exit through the passage in the lower member, move transversely between said lower and upper members and pass through the passageway in the upper member.

21. The device of claim 1 characterized in that said joint means comprise weakened hinge sections.

22. The device of claim 21 characterized in that said shield section also includes spaced-apart rear and front walls interconnected by laterally spaced-apart side walls and wherein said base wall portion is connected to said rear, side and front walls.

23. The device of claim 22 characterized in that the rear wall, front wall, laterally-spaced apart side walls, and base wall portion are each substantially planar.

24. The device of claim 1 characterized in that said wall means comprises a hub section having a passageway therethrough and attached to said base wall portion.

25. The device of claim 24 characterized by flow control passages extending through the base wall portion of the hood in communication with the passageway through the hub section for controlling the flow of steam passing through the passageway in said hub section.

26. The device of claim 24 characterized in that the flow control passages are provided in a disk that is removable supportable on a surface of the hub section adjacent the bottom wall of said shield.

27. The device of claim 24 characterized by a pair of generally parallel lower and upper baffle members spaced from each in the general direction of steam flow, said baffle members including surfaces transversely spaced from each other, each of said surfaces defining a boundary of a flow control passage for permitting steam to exit through the passage in the lower member, move transversely between said lower and upper members and pass through the passageway in the upper member.

28. A vaporizer and/or facial treatment device including a casing having a compartment therein for retaining liquid to be vaporized, an outlet communicating with said compartment through which steam created by vaporization of said liquid exits from said compartment, and heating means for vaporizing said liquid; characterized by a hood assembly including a collapsible shield section movable from an opened, extended condition for confining the flow of steam exiting through the casing of the compartment to a closed, collapsed condition during non-use of said hood assembly, said collapsible shield section including a bottom wall having an opening, laterally spaced-apart side walls and means connected to said bottom wall for releasably securing said collapsible shield section to said casing, said last mentioned means having a wall portion spaced below said bottom wall and located adjacent said opening for engagement with said casing and with said opening in communication with said outlet of said casing, said side walls including weakened hinge sections about which the collapsible shield section is adapted to move to permit said shield section to be moved between its opened, extended condition to its closed, collapsed condition.

* * * * *